US009276356B2

(12) United States Patent
Yu

(10) Patent No.: US 9,276,356 B2
(45) Date of Patent: Mar. 1, 2016

(54) CABLE CONNECTOR WITH SWITCH STRUCTURE

(71) Applicant: T-CONN PRECISION CORPORATION, New Taipei (TW)

(72) Inventor: Chien-Yi Yu, Taipei (TW)

(73) Assignee: T-Conn Precision Corporation, Taipei (TW)

( * ) Notice: Subject to any disclaimer, the term of this patent is extended or adjusted under 35 U.S.C. 154(b) by 9 days.

(21) Appl. No.: 14/164,250

(22) Filed: Jan. 26, 2014

(65) Prior Publication Data

US 2015/0194765 A1 Jul. 9, 2015

(51) Int. Cl.

| | |
|---|---|
| ***H01R 13/627*** | (2006.01) |
| ***H01R 13/629*** | (2006.01) |
| ***H01R 13/622*** | (2006.01) |
| ***H01R 29/00*** | (2006.01) |

(52) U.S. Cl.

CPC ..... *H01R 13/629* (2013.01); *H01R 13/622* (2013.01); *H01R 29/00* (2013.01)

(58) Field of Classification Search

CPC ..... H01R 13/6272; H01R 13/6275; H01R 13/641; H01R 13/639; H01R 13/6273

USPC ..... 439/352

See application file for complete search history.

(56) References Cited

U.S. PATENT DOCUMENTS 4,815,983 A * 3/1989 Erickson et al. ..... 439/173
7,727,021 B2 * 6/2010 Haruna et al. ..... 439/607.5

* cited by examiner

*Primary Examiner* — Phuong Dinh

(57) ABSTRACT

The invention is a cable connector with a switchover structure, comprising a plug connector having a plug rubber core, a housing, a pin terminal, a protruding rib and a wire; a plug holder harnessed on an outer edge of the plug rubber core movably; and a switching unit combined with the plug holder movably, furthermore, the said switching unit mentioned above is harnessed on the outer edge of the plug rubber core and is positioned between the housing and the plug holder. Therefore, by rotational switching of the switching unit may be utilized for the plug holder to be joined to different kinds of socket connectors, such that the effects and advantages of tight locking, detachment prevention, easy of assembly, easy of retreating, convenient replacement and maintenance, ease of operation and applicability to at least two different kinds of socket connectors are achieved as the cable connector and a socket connector are butted together.

5 Claims, 17 Drawing Sheets

CABLE CONNECTOR WITH SWITCH STRUCTURE

BACKGROUND OF THE INVENTION

1. Field of the Invention

The invention is a cable connector with a switchover structure, and is particularly related to a cable connector with a switchover structure used for power lines or signal lines.

2. Description of Prior Art

Conventional cable connectors may connect one cable to various devices. With the development of the technical industry, many connectors are developed continuously for users to perform rapid connection. More and more attention is rendered to the protection of cable connecting joints. However, in the process of cable connection, not only a connector should have basic good electrical connection properties, but also the body of the connector should have a certain bonding stress. Various external factors would cause the connector, after long term use, to have detachment, which results in separation from the cable, and in turn, results in ineffective electrical connection and safety issues. As the adapters of cables are connected with each other, one plug may only fit with a single kind of socket due to, usually, specification constraint for locking the adapters of cables firmly. Therefore, various kinds of socket and plug connectors have been developed. As shown in FIG. 7 showing a conventional socket connector, which does not comply with the purposes of high efficiency and multiple functions in the modern industrial society, and might result in material fatigue and structure wear because of long term use such that the original tight fitting function becomes worse. Thus, it is important to design a high efficiency cable connector adapter with multiple functions and capable of easy to operation and easy to maintenance.

The U.S. Pat. No. 7,727,021B2, "Connector having a plug, a socket, and a tubular shield member with an elastic arm" is a conventional technology. As shown in FIG. 8, the connector contains a plug 10, which comprises a plug main body 11, multiple pin terminals 20, a plug holder 40, a coil spring 49 and a slip-out preventing member 45, and a socket 60, which comprises a socket main body 61, multiple socket terminals 70, a socket holder 90. The plug 10 may be inserted to a socket without caulking portion, and may also be joined with the socket 60. As the plug 10 of the conventional technology is to be joined with the socket without caulking portion, an outer thread of the plug 10 is utilized to screw with an inner thread of the socket without caulking portion. Further, as the plug 10 is to be connected with the socket 60, an engagement nail 47 of a slip-out preventing member 45 for the plug holder 40 of the plug 10 is utilized to enter a recessed portion 83 and a caulking portion 84 in an inner chamber of the socket holder 90, and simultaneously, the coil spring 49 is contracted such that the coil spring 49 is utilized to apply an elastic thrust for the plug holder 40 and the socket holder 90 to be snapped firmly, while the pin terminals of the plug main body and the socket terminals of the socket main body 61 form electrical connection. Thereby, a connector applicable to two kinds of sockets is available. However, such cable connector utilizes springs as switching and caulking structures, which would result in reduced bonding stress due to ineffective elasticity or displacement of springs after long term use, and lose the functions of switching and caulking. Moreover, once the adapter of such connector is detached, issues with respect to power transmission interrupt would occur easily in combination with safety issues. Furthermore, springs are located in the inner chamber of the plug such that assembly & mounting, retreat and maintenance are inconvenient for the cable connector, and the requirement of convenience and high efficiency is not met.

In view of the fact, the applicant of the invention has made efforts to study and develop an improved cable connector with a switchover structure in order to fix various conventional shortages mentioned above.

SUMMARY OF THE NEW MODEL

One major object of the invention is that the rotational switching of the switching unit may be utilized for the plug holder to be joined to different kinds of socket connectors, while the effects of tight locking, detachment prevention, easy to assemble, easy to retreat, convenient replacement and maintenance, easy to operate and applicability to at least two different kinds of socket connectors are achieved as the cable connector and a socket connector are butted together.

To achieve the purposes above, the preferred embodiment of the invention is a cable connector with a switchover structure, comprising a plug connector having a plug rubber core, a housing, a pin terminal, a protruding rib and a wire; a plug holder harnessed on an outer edge of the plug rubber core movably; and a switching unit combined with the plug holder movably, furthermore, the switching unit mentioned above is harnessed on the outer edge of the plug rubber core and is positioned between the housing and the plug holder.

In the preferred embodiment, the plug holder contains a holding portion and a screw harness portion provided on one end of the holding portion, while the switching unit abuts against one side of the holding portion.

In the preferred embodiment, the holding portion is provided with a connection part and a guiding bump on an inner edge thereof, while the screw harness portion is provided with multiple openings on a periphery thereof, and each of the openings is provided with a catch bump therein, and the holding portion is provided with at least one marking portion on a surface thereof.

In the preferred embodiment, the switching unit contains a knob and a switching ring, which is combined with and provided on one end surface of the knob.

In the preferred embodiment, the knob has multiple protrusion portions on one end thereof, while it has multiple slots for the switching ring to butt on the other end, and the knob is surrounded with one circular groove, which is scarfed with the connection part on the outer edge thereof, and the knob is provided with an intervention portion thereon, which fits with the guiding bump mutually, and the intervention portion is provided with one groove and one block portion on each of two sides thereof.

In the preferred embodiment, the switching ring contains a ring, multiple insertion portions provided on one end of the ring in order to with the slots, and multiple elastic numbers provided on the other end of the ring and extending in each of the openings.

Another preferred embodiment of the invention comprises: a plug holder harnessed onto an outer edge of a plug rubber core movably, the plug holder containing a holding portion and a screw harness portion provided on one end of the holding portion; and a switching unit combined with the plug holder movably and harnessed onto the outer edge of the plug rubber core movably, which is positioned between a housing and the plug holder, the switching unit containing a knob and a switching ring combined with and provided on one end of the knob, the knob is abutting against one side of the holding portion.

In another preferred embodiment, the holding portion is provided with a connection part and a guiding bump on an inner edge thereof, while the screw harness portion is provided with multiple openings on a periphery thereof, each of the openings is provided with a catch bump therein, and the holding portion is provided with at least one marking portion on a surface thereof.

In another preferred embodiment, the knob has multiple protrusion portions on one end thereof, while it has multiple slots for the switching ring to butt on the other end, and the knob is surrounded with one circular groove, which is scarfed with the connection part, on the outer edge thereof, and the knob is provided with an intervention portion thereon, which fits with the guiding bump mutually, and the intervention portion is provided with one groove and one block portion on each of two sides thereof.

In another preferred embodiment, the switching ring contains a ring, multiple insertion portions provided on one end of the ring in order to butted with the slots, and multiple elastic numbers provided on the other end of the ring and extending in each of the openings.

DETAILED DESCRIPTION OF THE PREFERRED EMBODIMENTS

The invention is demonstrated in detail in conjunction with attached drawings below by the following detailed description of preferred embodiments in order for full understanding of the intensions, features and effects of the invention.

Figure 1:
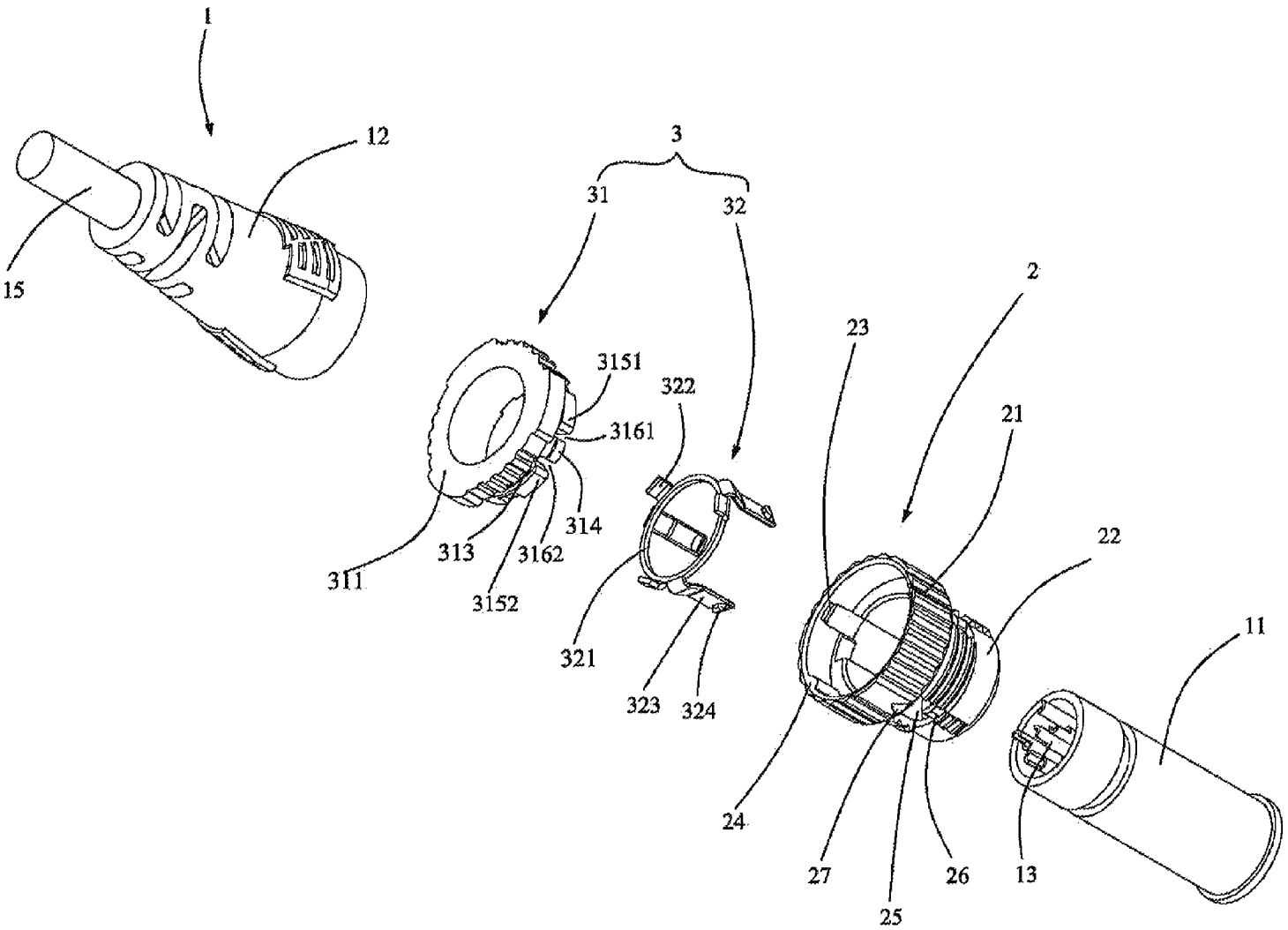
FIG. 1 shows a schematic view showing an exploded drawing of the invention.
Figure 2:
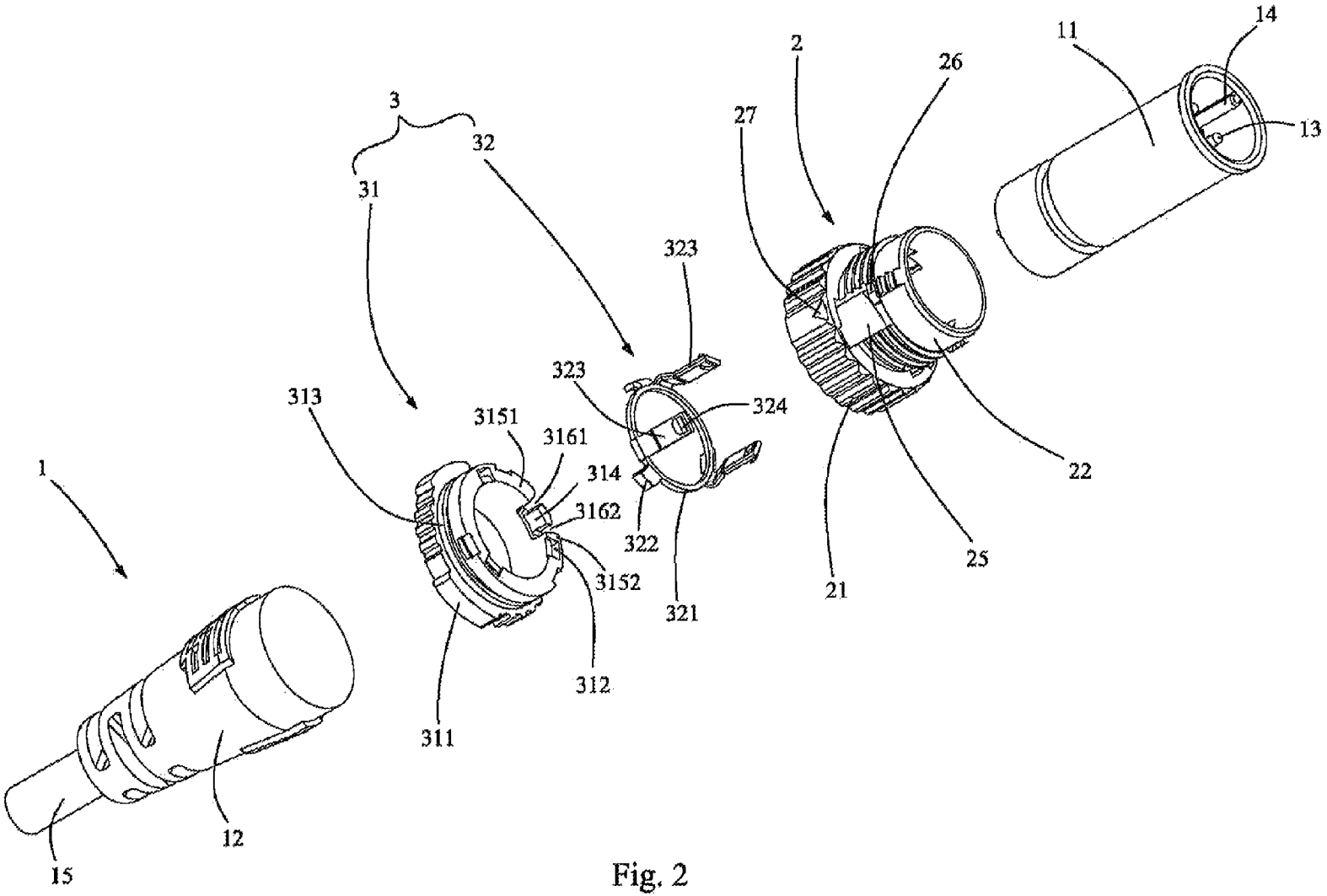
FIG. 2 shows a schematic view showing an exploded drawing of the invention from another angle.
Figure 3:
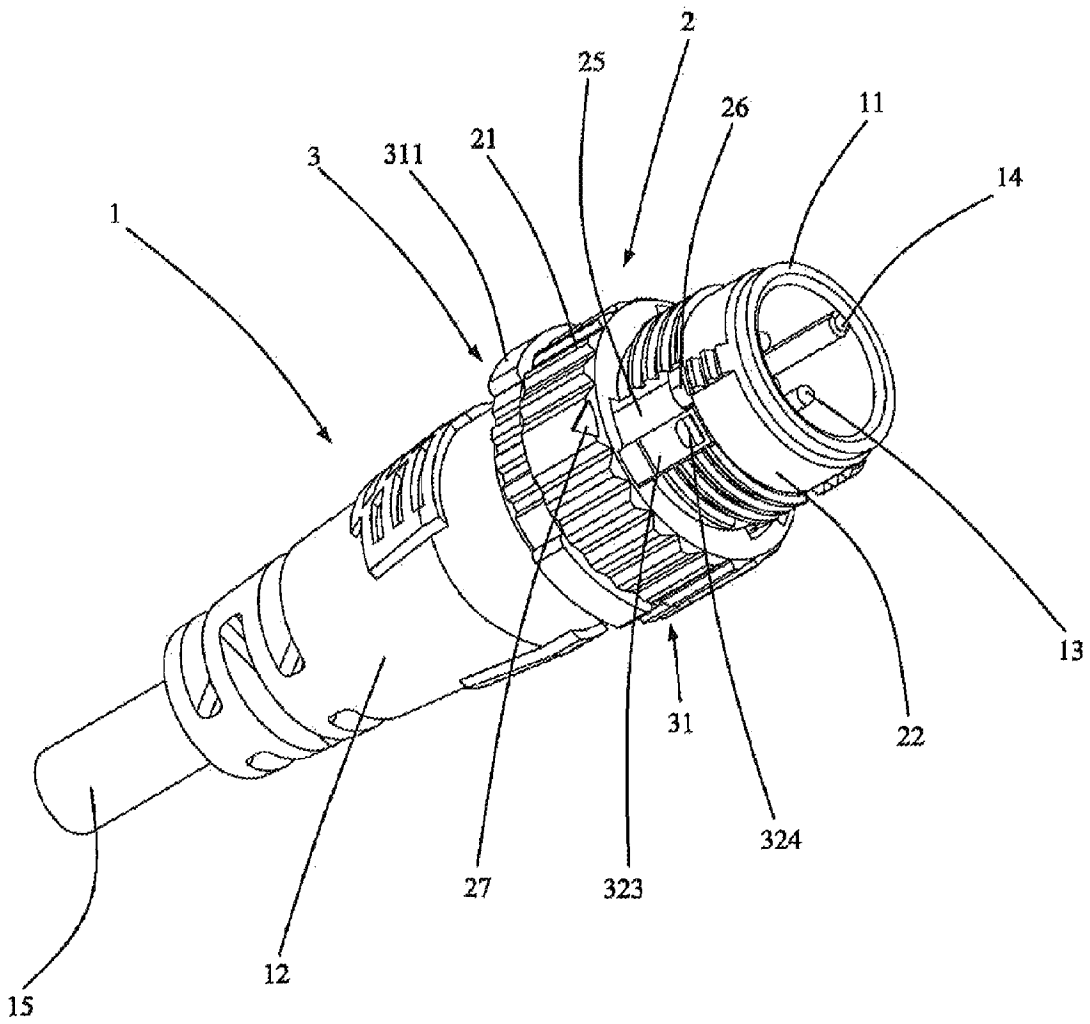
FIG. 3 shows a schematic view showing a 3D (three-dimensional) appearance of the invention.
Figure 4:
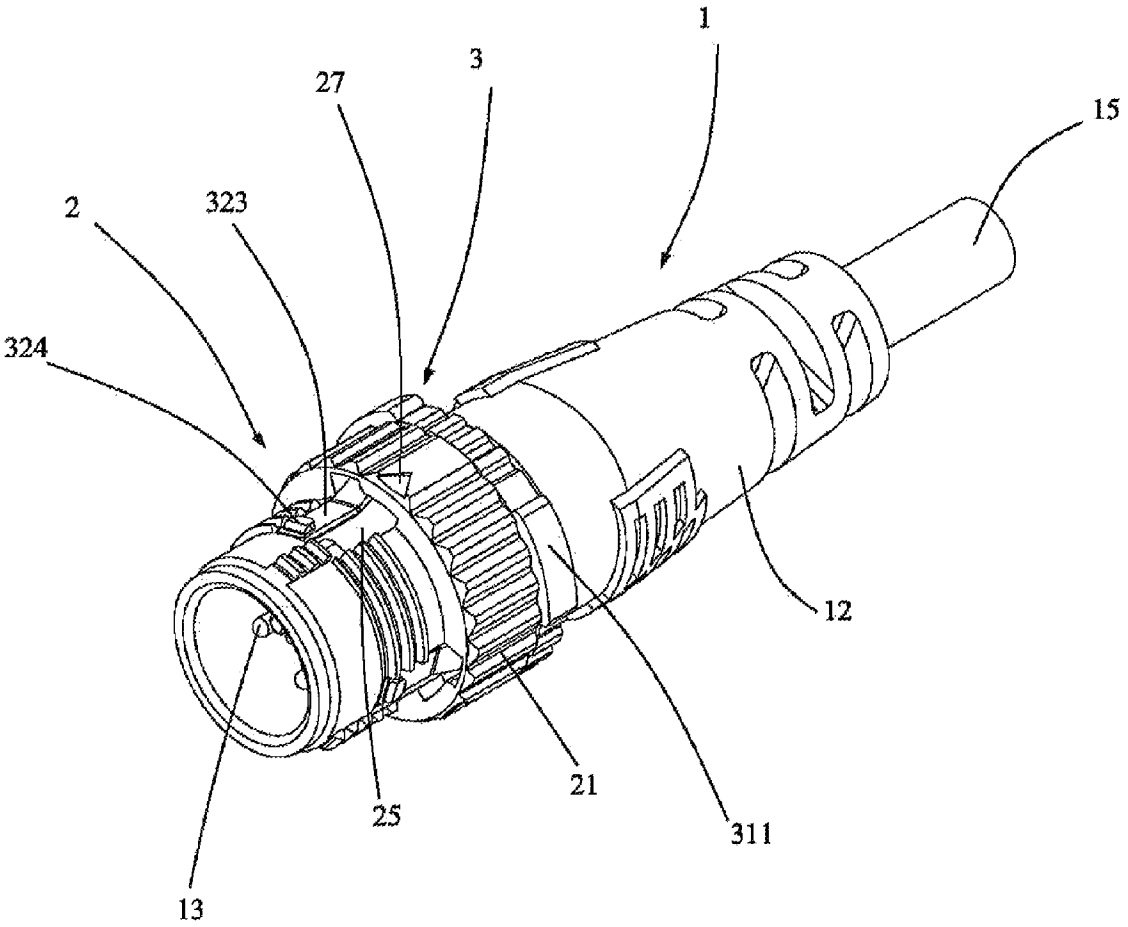
FIG. 4 shows a schematic view showing a 3D appearance of the invention from another angle.

Refer to FIGS. 1, 2, 3 and 4, which are a schematic view showing a 3D (three-dimensional) exploded drawing of the invention, a schematic view showing an exploded pictorial drawing of the invention from another angle, a schematic view showing a 3D appearance of the invention, and a schematic view showing a 3D appearance of the invention from another angle. As shown in the figures, the invention is a cable connector with a switchover structure composed of at least one plug connector 1, one plug holder 2 and one switching unit 3.

As above, the plug connector 1 contains a plug rubber core 11, a housing 12 covering the plug core 11, multiple pin terminals 13 provided within the plug rubber core 11, a protruding rib 14 provided on the inner surface of the plug rubber core 11, and a wire 15 connecting each of the pin terminals 13.

The plug holder 2 is harnessed onto the outer edge of the plug rubber core 11 movably, while the plug holder 2 contains a holding portion 21 and a screw harness portion 22 provided on one end of the holding portion 21, wherein the inner edge of the holding portion 21 is provided with a connection part 23 and a guiding bump 24, while the periphery of the screw harness portion 22 is provided with multiple openings 25, in each of which a catch bump 26 is provided, and a surface of the holding portion 21 is provided with at least one marking portion 27.

The switching unit 3 is combined with the plug holder 2 movably, and is harnessed onto the outer edge of the plug rubber core 11, which is disposed between the housing 12 and the plug holder 2. In addition, the switching unit 3 contains a knob 31 abutting against one side of the holding portion 21, and a switching ring 32 combined with and provided on one end of the knob 31, wherein one end of the knob 31 has multiple protrusion portions 311, while the other end thereof has multiple slots 312 for the switching ring 32 to butt with. Further, the outer edge of the knob 31 is surrounded with a circular groove 313 scarfed with the connection part 23 such that the knob 31 and the plug holder 2 are combined movably by the fitting between the connection part 23 and the circular groove 313. Moreover, the knob 31 is provided with an intervention portion 314 thereon fitting with the guiding bump 24 mutually, and the intervention portion 314 is provided with a first block portion 3151 and a second block portion 3152 on two sides thereof. Furthermore, a first groove 3161 is provided between the intervention portion 314 and the first block portion 3151, and a second groove 3162 is provided between the intervention portion 314 and the second block portion 3152. In addition, the switching ring 32 contains a ring 321, multiple insertion portions 322 provided on one end of the ring 321 in order to butt with slots 312, and multiple elastic numbers 323 provided on the other end of the ring 321 and extending in each of the openings 25.

Figure 5A:
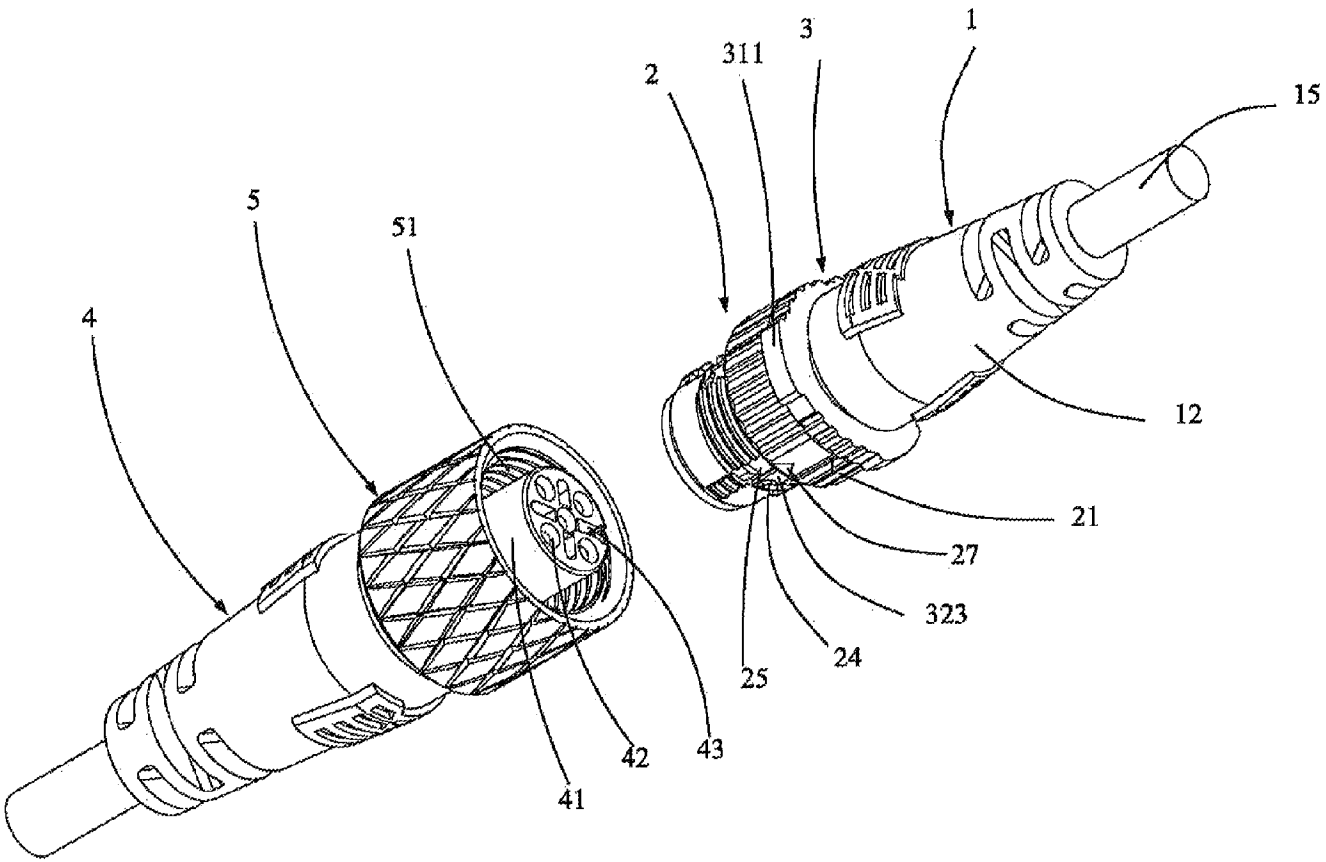
FIG. 5A to 5D show schematic views showing a first operation state of the invention.
Figure 5B:
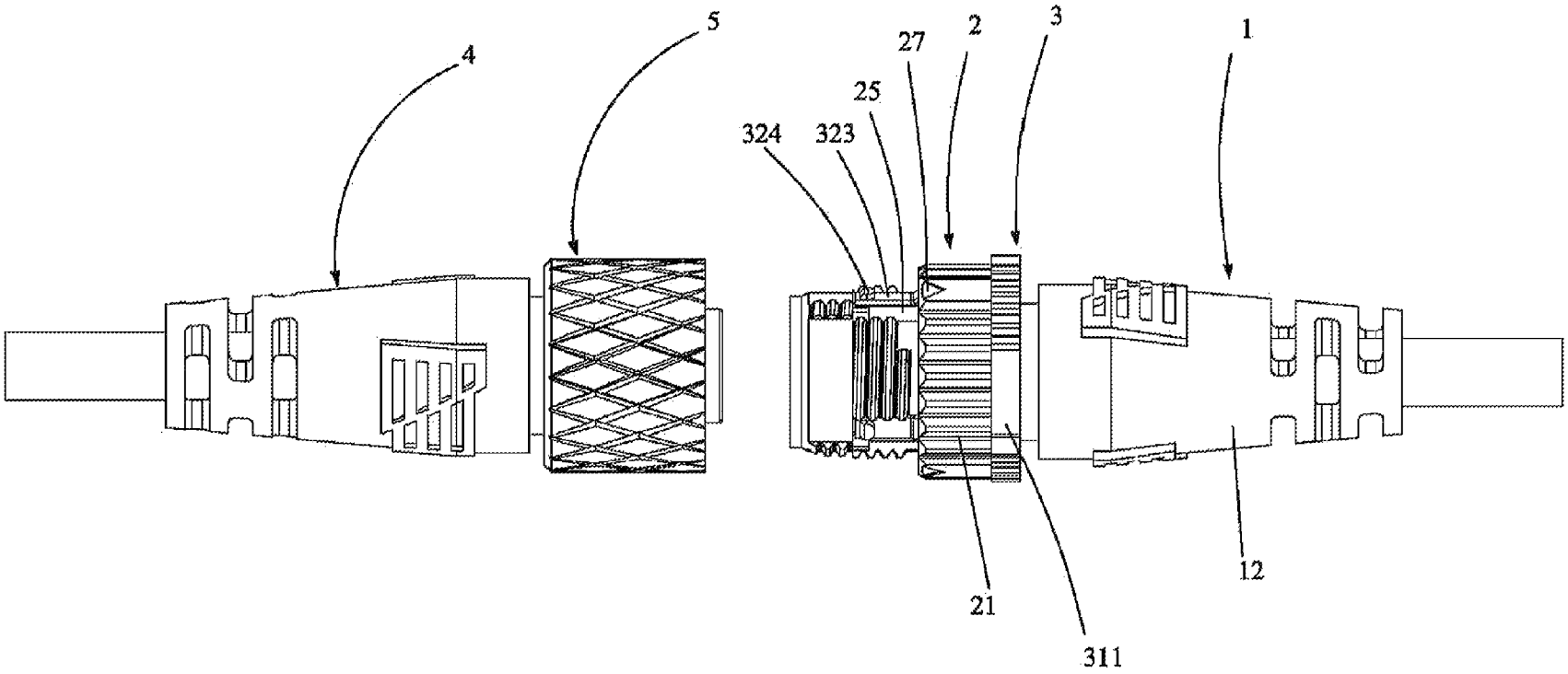
Figure 5C:
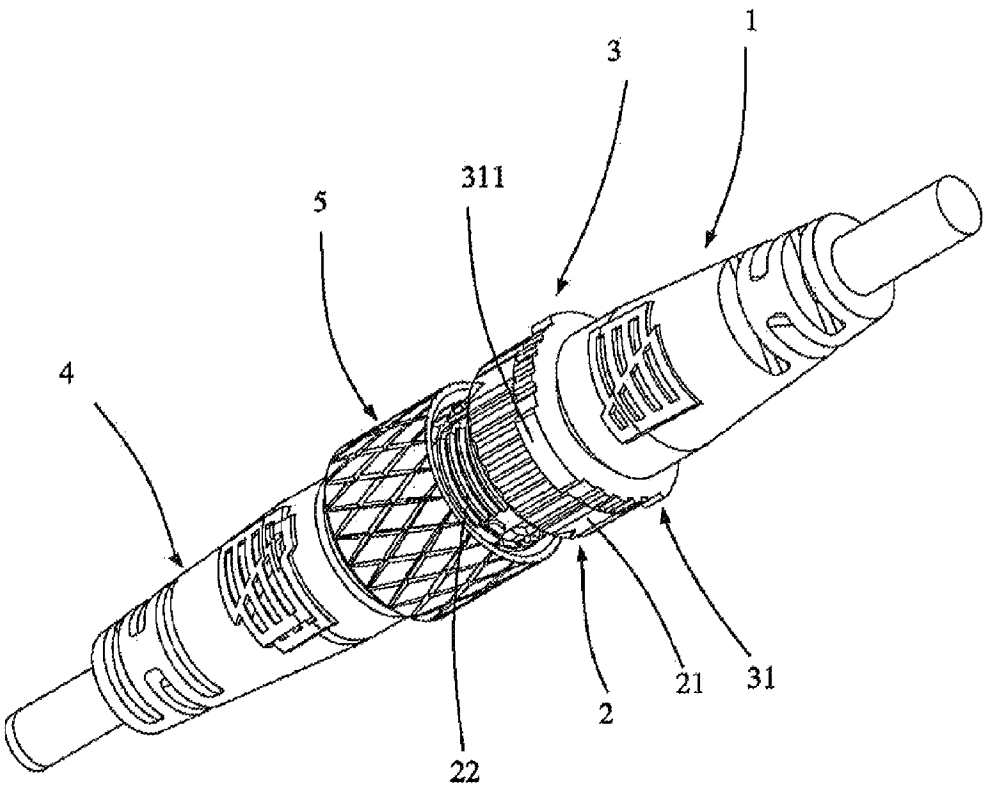
Figure 5D:
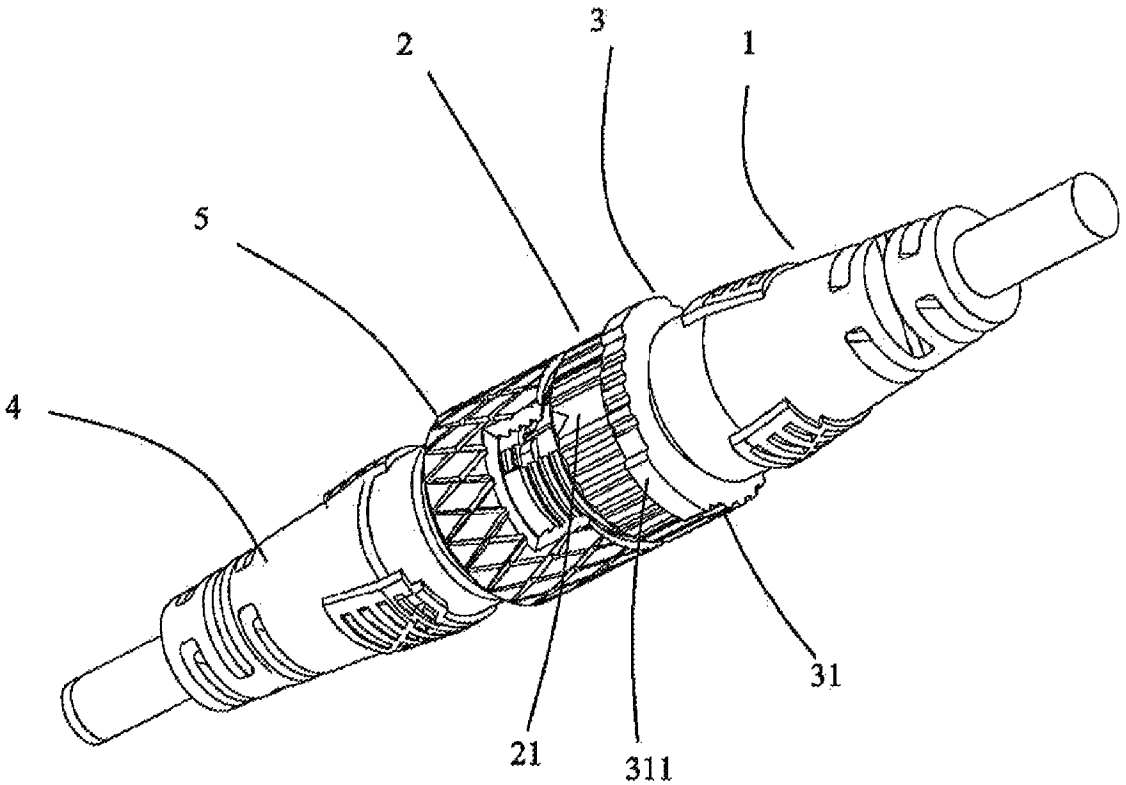

Refer to FIG. 5A to 5D, which are schematic views showing a first operation state of the invention. As shown in the figures, when the plug connector 1 and the plug holder 2 of the invention are intended to be joined with a general socket connector 1 and a socket holder 5 thereof, which does not have claspjoint portion (also refer to FIGS. 1 to 4), each of the protrusion portions 311 is held to rotate the knob 31 towards one side (left side), such that the knob 31 drives the switching ring 32 for each of the elastic numbers 323 on the switching ring 32 to be displaced to one side of the opening 25 without the catch bump 26, so that the knob 31 is limited to the second block portion 3152 (refer to FIG. 1) by the intervention portion 314 provided therewith and the guiding bump 24 in the plug holder 2. Meanwhile, each of the elastic numbers 323 is in a contraction state on the screw harness portion 22. Once aforementioned operations are accomplished, the plug rubber core 11 of the plug connector 1 may be utilized to butt with a socket rubber core 41 of the socket connector 4, and the protruding rib 14 of the plug connector 1 is allowed to correspond to fit a longitudinal slot 43 of the socket connector 4. After the plug rubber core 11 and the socket rubber core 41 are joined with each other and the protruding rib 14 engages into the longitudinal slot 43 of the socket connector 4, each of the socket terminals 42 of the socket connector 4 joins with the pin terminal 13 of the plug connector 1 with electrical connection performed. Subsequently, after the plug holder 2 is screwed into the socket holder 5 by rotating the holding portion 21 of the plug holder 2, the mutual engagement for the screw harness portion 22 of the plug holder 2 and inner thread 51 of the socket holder 5 is accomplished.

Figure 6A:
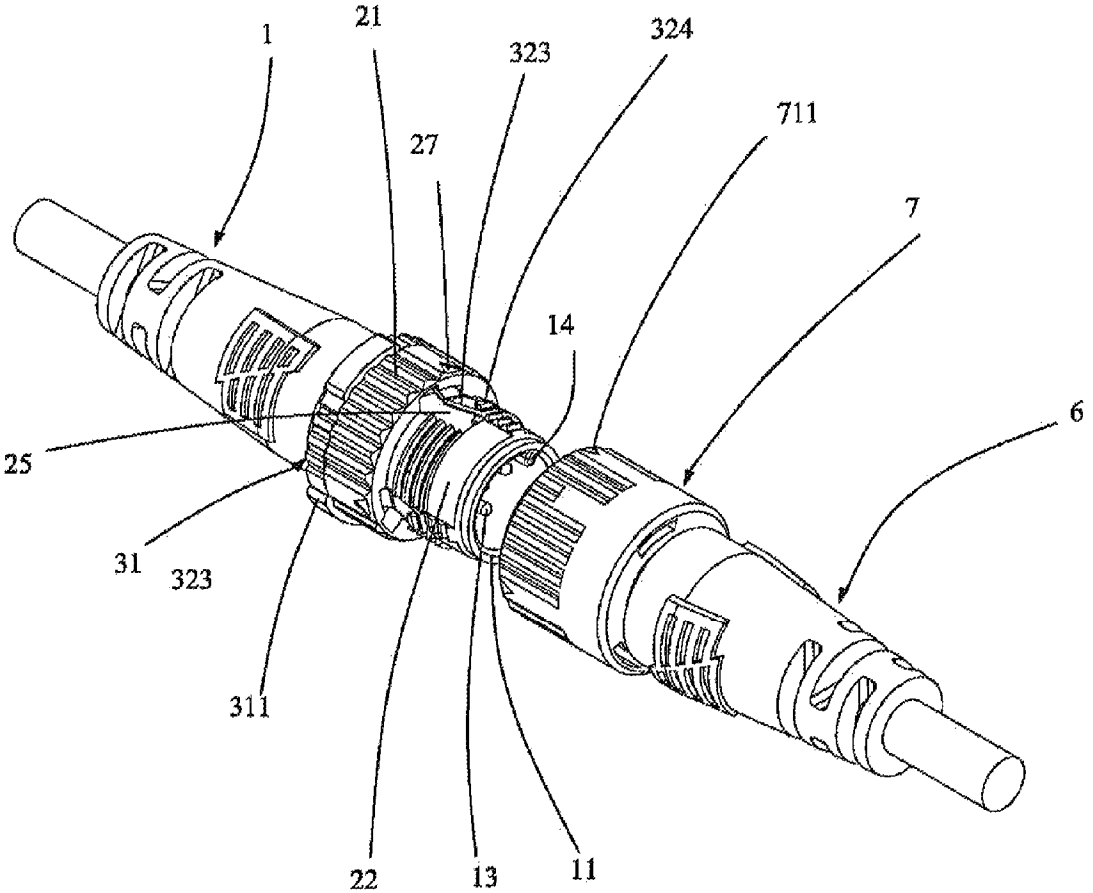
FIG. 6A to 6G show schematic views showing a second operation state of the invention.
Figure 6B:
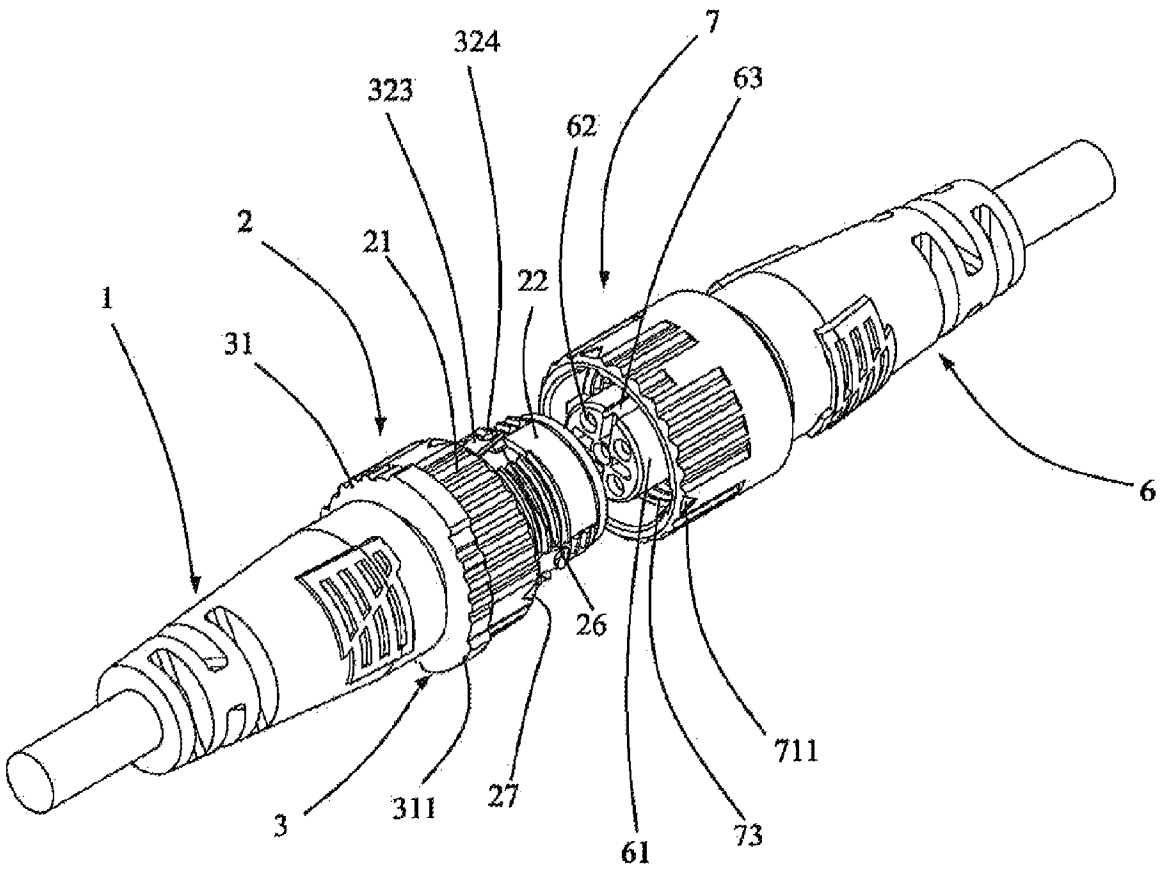
Figure 6C:
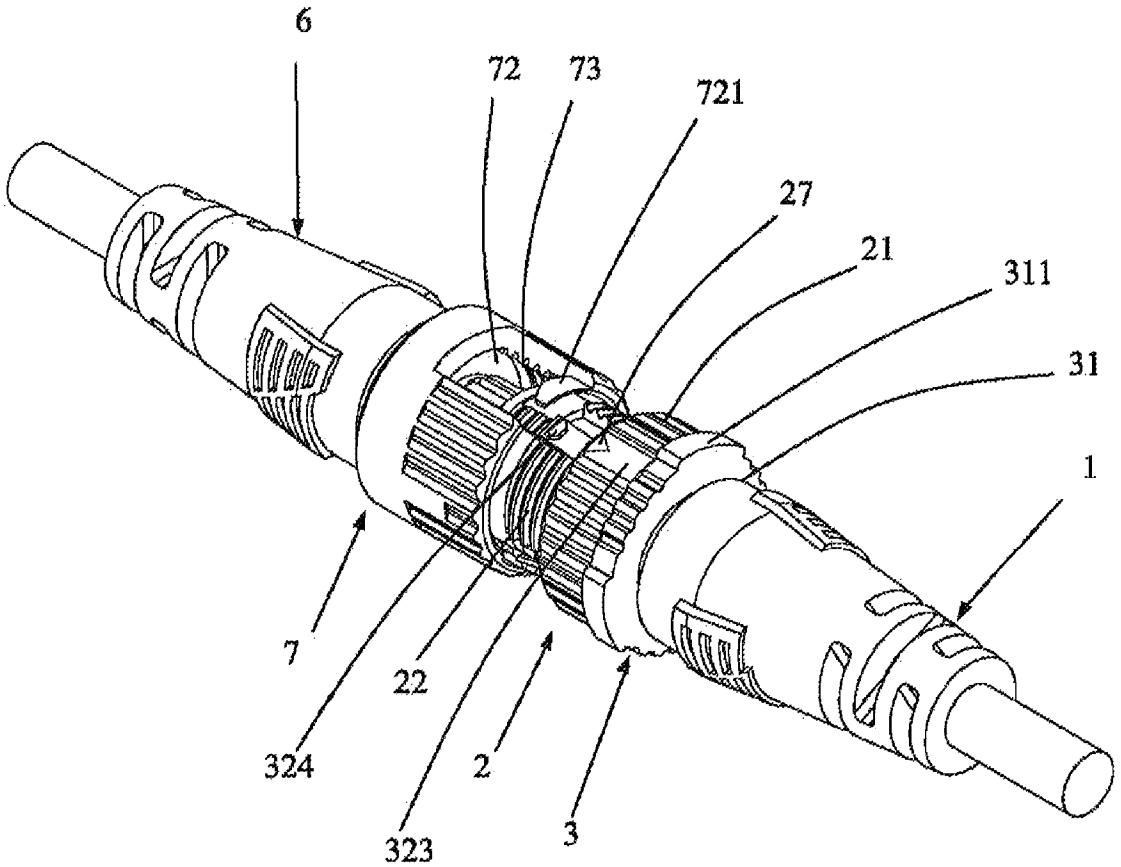
Figure 6D:
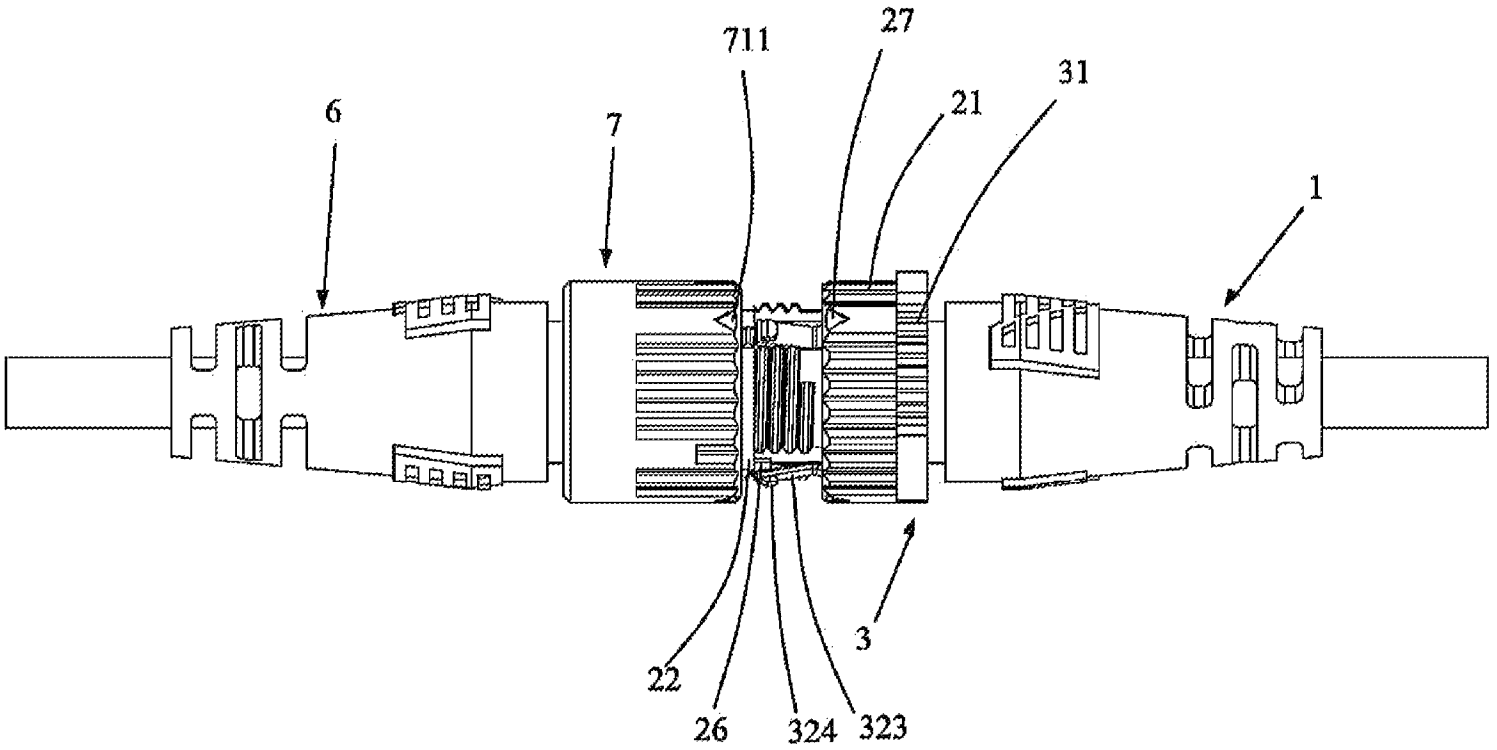
Figure 6E:
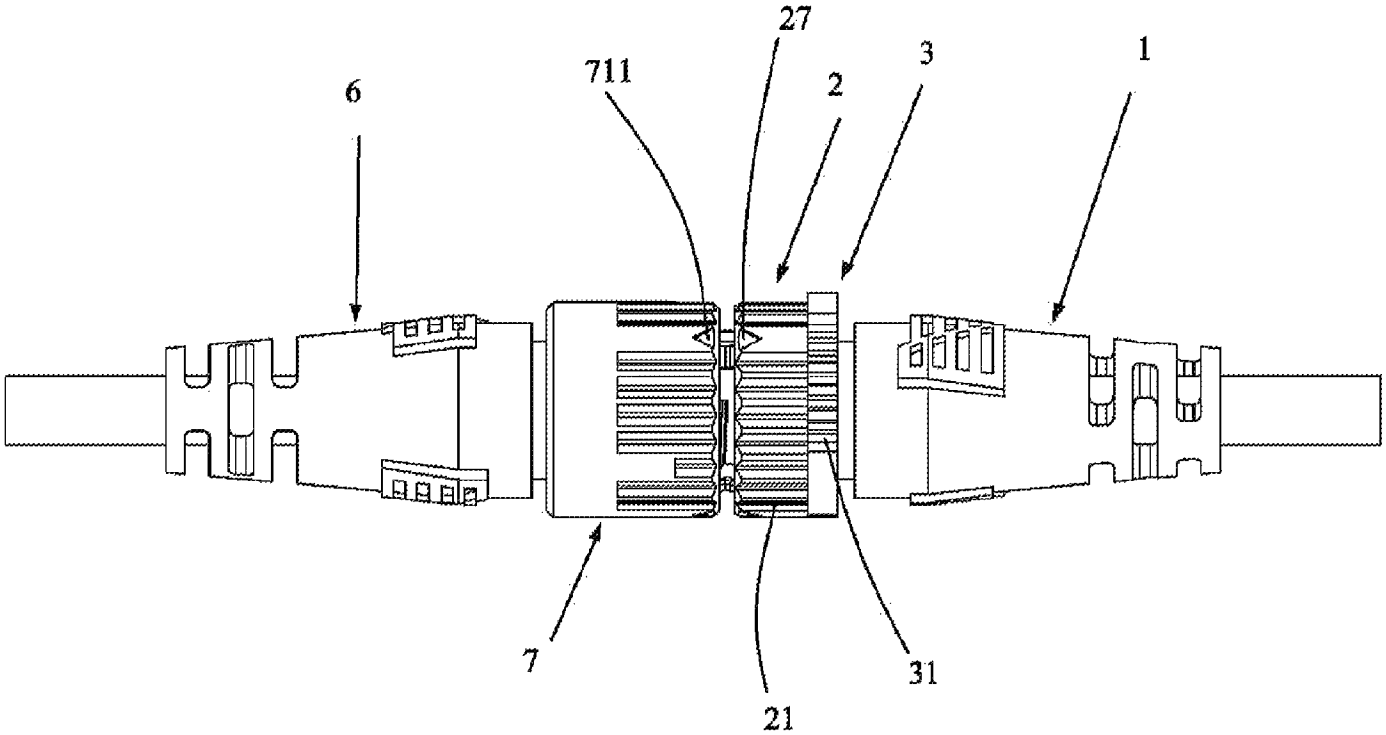
Figure 6F:
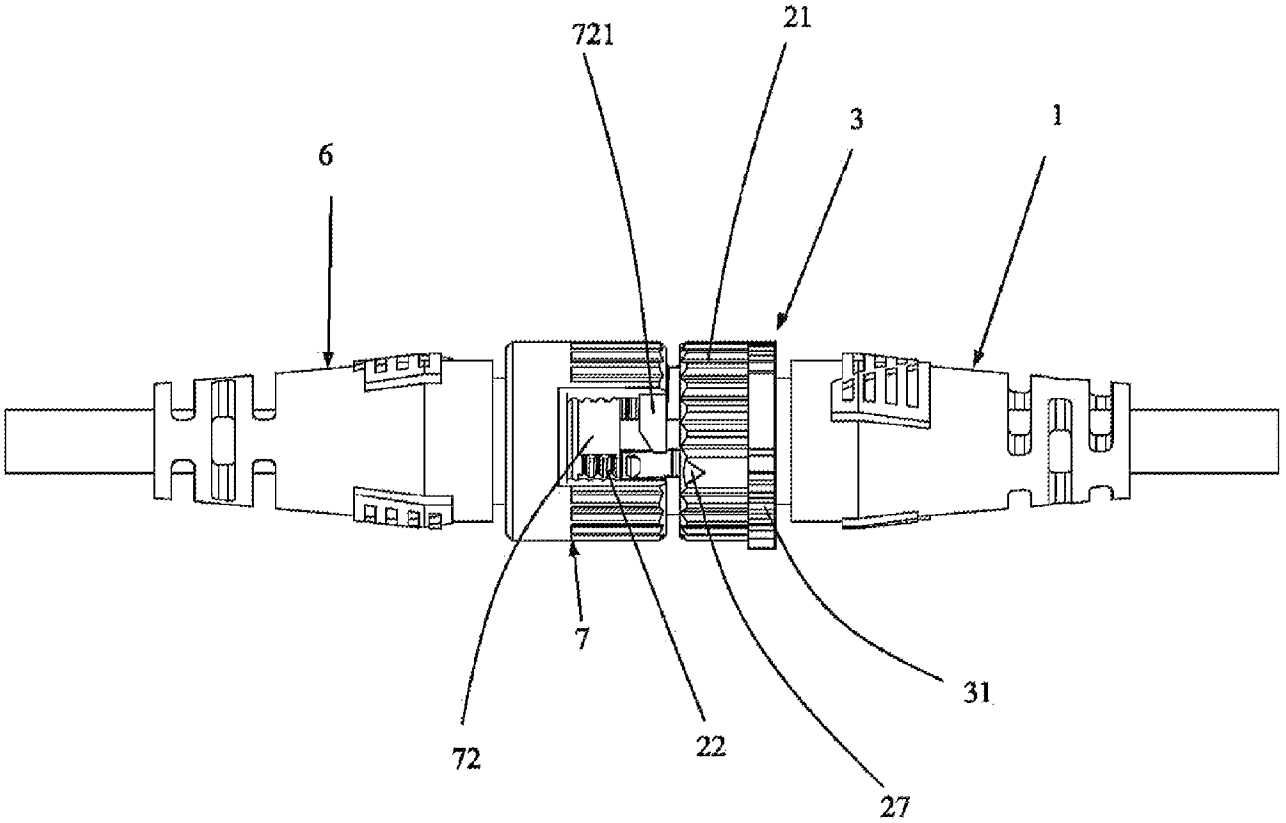
Figure 6G:
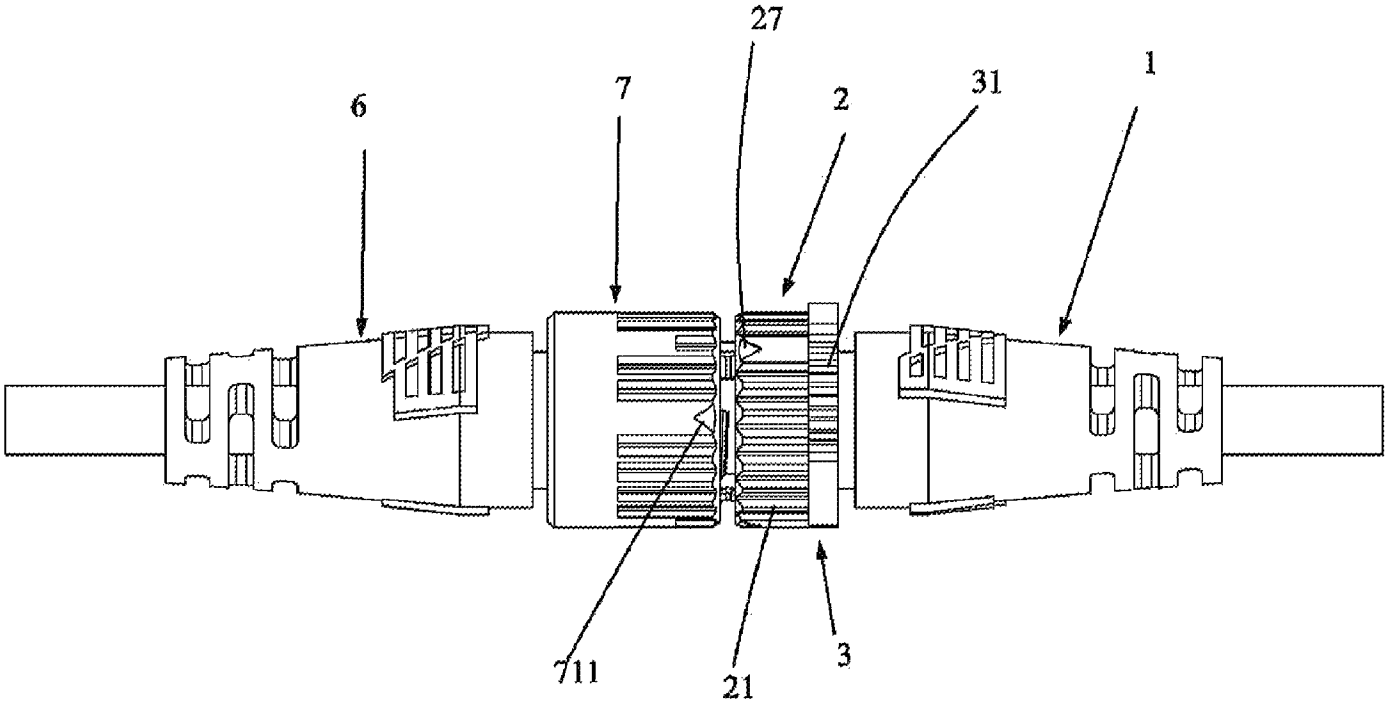
Figure 7:
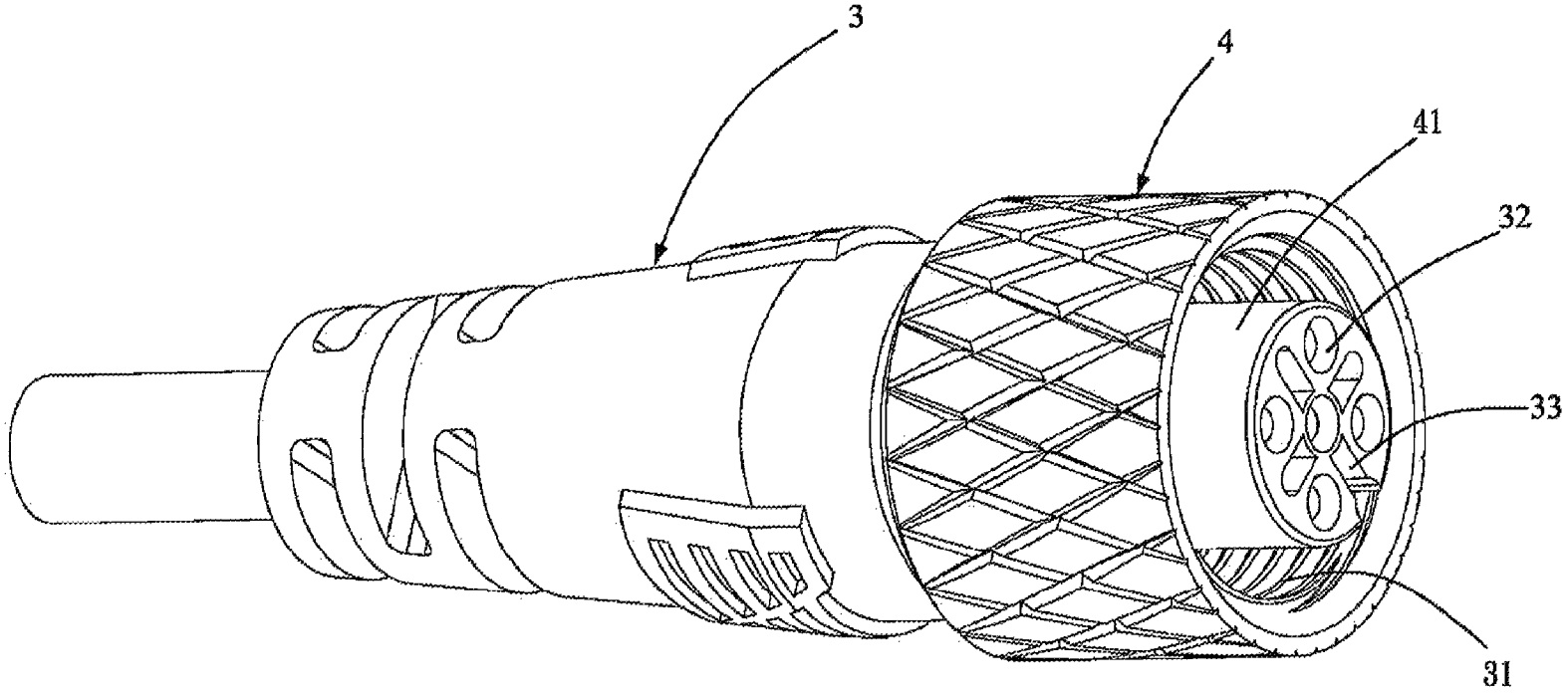
FIG. 7 shows a 3D appearance view of a conventional socket connector.
Figure 8:
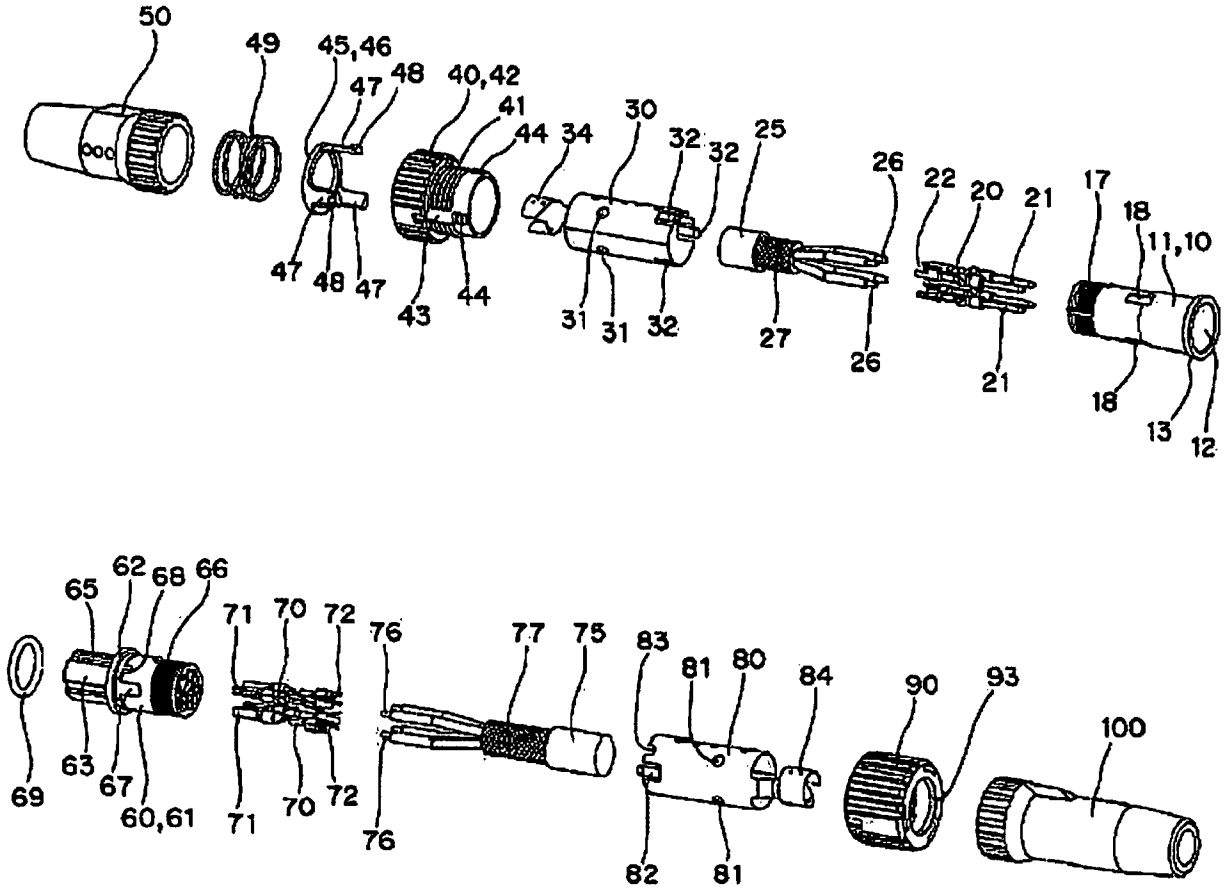
Fig.8 Prior Art
FIG. 8 shows a 3D exploded view showing a cable connector of a prior art.

Refer to FIG. 6A to 6G, which are schematic views showing a second operation state of the invention. As shown in the figures, when the plug connector 1 and the plug holder 2 are intended to be connected with the socket connector 6 and the socket holder 7 thereof, which has a claspjoint portion (also refer to FIGS. 1 to 4), each of the protrusion portions 311 is held to rotate the knob 31 towards another side (the right side) for the knob 31 to drive the switching ring 32, such that each of the elastic numbers 323 on the switching ring 32 is displaced to one side of the opening 25 provided with the catch bump 26, so that the knob 31 is, in virtue of the intervention portion 314 provided therewith and the guiding bump 24 in the plug connector 2, limited to the first block portion 3151 (refer to FIG. 1), that is, the first limiting point formed between the intervention portion 314 and the first block portion 3151, at which the limiting is done by the guiding bump 24, or limited to the second limiting point formed between the intervention portion 314 and the second block portion 3152, and in turn, each of the elastic numbers 323 is shown in an upward supporting form in each of the openings 25 of the plug holder 2. After the operations mentioned above are accomplished, the correspondence to match a marking portion 711 on the surface of the socket holder 7 with a claspjoint portion 72 is available by the marking portion 27 on the surface of the holding portion 21, and the plug rubber core 11 of the plug connector 1 is utilized to butt with the socket rubber core 61 of the socket connector 6. Meanwhile, the protruding rib 14 of the plug connector 1 is allowed to correspond to fit a longitudinal slot 63 of the socket connector 6. Once the plug rubber core 11 and the socket rubber core 41 are combined with each other and the protruding rib 14 engages into the longitudinal slot 63 of the socket connector 6 completely, each of socket terminals 62 of the socket connector 6 is joined simultaneously with the pin terminal 12 of the socket connector 1 to perform electrical connection, such that the plug holder 2 mentioned above engages into the socket holder 7 for each of the elastic numbers 323 to enter the socket holder 7 along a recessed portion 71. After that, the socket holder 7 with a claspjoint portion is rotated for each of the elastic numbers 323 to move along a claspjoint portion 72. The marking portion 27, which is butted with the marking portion 711 originally, is moved toward a locating block 712 for each of the elastic numbers 323 to snap on a claspjoint surface 721, and simultaneously, for a protrusion point 324 on the front end of each of the elastic numbers 323 to abut against the claspjoint surface 721 of the claspjoint portion 72 in order for improved firmness, such that the said plug holder 2 and socket holder 7 are engaged for caulking in order to achieve the effect of firm fitness for the cable connector. On the contrary, as each of the elastic numbers 323 to be operated is retreated from the claspjoint surface 721, the retreating operation of the plug holder 2 and the socket holder 7 is accomplished simply by rotating the socket holder 7 with a claspjoint portion reversely for each of the elastic numbers 323 to move to abut against the claspjoint portion 72, followed by retreating the plug holder 2 by an outward force along the recessed portion 71. Therefore, the rotational switching of knob 31 at the first limiting point or the second limiting point is accomplished to be suitable for two different kinds of socket connectors, and the cable connector can be prevented from detachment and the effects of easy assembly and retreating are achieved.

In summary, the invention can achieve the desired purpose of the invention actually. In virtue of the cable connector with a switchover structure, by the rotational switching of the switching unit may be utilized for the plug holder to be joined to different kinds of socket connectors, while the effects and advantages of tight locking, detachment prevention, easy to assemble, easy to retreat, convenient replacement and maintenance, easy to operate and the applicability to at least two different kinds of socket connectors are achieved as the cable connector and a socket connector are butted together.

What is claimed is:

1. A cable connector with a switchover structure, comprising:

a plug connector comprising a plug rubber core, a housing covering said plug rubber core, multiple pin terminals provided in said plug rubber core, one protruding rib provided on an inner surface of said plug rubber core, and a wire connecting each of said pin terminals;

a plug holder harnessed onto an outer edge of said plug rubber core movably, said plug holder contains a holding portion and a screw harness portion provided on one end of said holding portion, while said switching unit abuts against one side of said holding portion, and said holding portion is provided with a connection part and a guiding bump on an inner edge thereof, while said screw harness portion is provided with multiple openings on a periphery thereof, and each of said openings is provided with a catch bump therein, and said holding portion is provided with at least one marking portion on a surface thereof; and a switching unit combined with said plug holder movably, which is harnessed onto an outer edge of said plug rubber core movably and positioned between said housing and said plug holder, said switching unit contains a knob and a switching ring, which is combined with and provided on one end surface of said knob, and knob has multiple protrusion portions on one end thereof, while has multiple slots for said switching ring to butt, and said knob is surrounded with one circular groove, which is scarfed with said connection part, on the outer edge thereof, and said knob is provided with an intervention portion thereon, which fits with said guiding bump mutually, and said intervention portion is provided with one block portion on each of two sides thereof, said switching ring contains a ring, multiple insertion portions provided on one end of said ring and butted with said slots, and multiple elastic numbers provided on the other end of said ring and extending in each of said openings.

2. A cable connector with a switchover structure, wherein said switchover structure comprises:

a plug holder harnessed onto an outer edge of a plug rubber core movably, said plug holder containing a holding portion and a screw harness portion provided on one end of said holding portion; and a switching unit combined with said plug holder movably and harnessed onto said outer edge of said plug rubber core movably and positioned between a housing and said plug holder, said switching unit containing a knob and a switching ring combined with and provided on one end of said knob, said knob abutting against one side of said holding portion.

3. The cable connector with a switchover structure according to claim 2, wherein said holding portion is provided with a connection part and a guiding bump on an inner edge thereof, while said screw harness portion is provided with multiple openings on a periphery thereof, and each of said openings is provided with a catch bump therein, and said holding portion is provided with at least one marking portion on a surface thereof.

4. The cable connector with a switchover structure according to claim 3, wherein said knob has multiple protrusion portions on one end thereof, while has multiple slots for said switching ring to butt with, and said knob is surrounded with one circular groove, which is scarfed with said connection part on the outer edge thereof, and said knob is provided with an intervention portion thereon, which fits with said guiding bump mutually, and said intervention portion is provided with one block portion on each of two sides thereof.

5. The cable connector with a switchover structure according to claim 4, wherein said switching ring contains a ring, multiple insertion portions provided on one end of said ring and butted with said slots, and multiple elastic numbers provided on the other end of said ring and extending in each of said openings.

* * * * *